US012729865B2

(12) United States Patent
Dorna et al.

(10) Patent No.: US 12,729,865 B2
(45) Date of Patent: Sep. 8, 2026

(54) MODULAR HVAC-SHW SYSTEM AND A METHOD OF INTEGRATING THEREOF

(71) Applicant: Carrier Corporation, Palm Beach Gardens, FL (US)

(72) Inventors: Luke Dorna, Rowsell, GA (US); Michel Grabon, Montluel (FR); Brian Caffarel, Raleigh, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 353 days.

(21) Appl. No.: 18/513,868

(22) Filed: Nov. 20, 2023

(65) Prior Publication Data

US 2024/0167701 A1 May 23, 2024

Related U.S. Application Data

(60) Provisional application No. 63/384,515, filed on Nov. 21, 2022.

(51) Int. Cl.
*F24F 3/00* (2006.01)
*F24H 4/04* (2006.01)
(Continued)

(52) U.S. Cl.
CPC ..... *F24F 3/001* (2013.01); *F24H 4/04* (2013.01); *F24H 7/0233* (2013.01); *F24F 2120/10* (2018.01); *F24F 2140/20* (2018.01)

(58) Field of Classification Search
CPC .... F24F 3/001; F24F 2120/10; F24F 2140/20; F24H 4/04; F24H 7/0233
See application file for complete search history.

(56) References Cited

U.S. PATENT DOCUMENTS 4,034,801 A * 7/1977 Bernstein ..... F25B 29/00 165/59
4,798,240 A 1/1989 Gerstmann et al.
(Continued)

FOREIGN PATENT DOCUMENTS

CA 2746405 C 10/2015
CN 201392050 Y 1/2010
(Continued)

OTHER PUBLICATIONS

Toru et al., Flow Rate Control System . . . , Sep. 25, 2003, JP2003269779A, Whole Document (Year: 2003).*
(Continued)

*Primary Examiner* — Larry L Furdge
(74) *Attorney, Agent, or Firm* — Drew Folgmann

(57) ABSTRACT

A modular HVAC-SHW/DHW system that provides comfort conditioning, sanitary hot water, and ventilation in the buildings is disclosed. The system includes HVAC units, SHW/DHW units, and one or more air-to-water heat pump (AWHP) units fluidically connected to the HVAC units and the SHW/DHW units through at least one water-to-water heat pump (WWHPs). The AWHP units are configured to enable the exchange of heat between the environment and the WWHPs, and the WWHP is configured to enable the exchange of rejected heat between any of the AWHP units, the HVAC units, and the SHW/DHW units. The system is designed in a packaged form factor or modular design, where the components/units of the system are configured within a housing that is easily installable at the desired locations in the building.

20 Claims, 13 Drawing Sheets

(51) Int. Cl.

| | |
|---|---|
| ***F24H 7/02*** | (2022.01) |
| *F24F 120/10* | (2018.01) |
| *F24F 140/20* | (2018.01) |

(56) References Cited

U.S. PATENT DOCUMENTS

| | | | | |
|---|---|---|---|---|
| 10,012,393 | B2 | 7/2018 | Deivasigamani et al. | |
| 11,073,301 | B2 | 7/2021 | Singh et al. | |
| 11,187,418 | B1 | 11/2021 | DeLoach et al. | |
| 2011/0120179 | A1 | 5/2011 | Chin et al. | |
| 2012/0052791 | A1* | 3/2012 | Kurelowech | F24F 11/64 454/329 |
| 2012/0216558 | A1 | 8/2012 | Dempsey et al. | |
| 2018/0093900 | A1* | 4/2018 | Dickson | C02F 1/001 |
| 2019/0107296 | A1 | 4/2019 | Clark et al. | |
| 2019/0376715 | A1* | 12/2019 | Blanchard | F24F 11/0001 |
| 2020/0182558 | A1* | 6/2020 | Alsadah | F25B 27/00 |

FOREIGN PATENT DOCUMENTS

| | | | |
|---|---|---|---|
| CN | 202133184 | U | 2/2012 |
| CN | 206531233 | U | 9/2017 |
| DE | 202008013091 | U1 | 1/2009 |
| DE | 102011005231 | A1 | 9/2012 |
| EP | 1593915 | A1 | 11/2005 |
| EP | 1239234 | B1 | 5/2006 |
| EP | 1674802 | B2 | 6/2006 |
| EP | 2713112 | A2 | 4/2014 |
| EP | 2787288 | A1 | 10/2014 |
| EP | 2672190 | B1 | 8/2015 |
| EP | 3367016 | A1 | 8/2018 |
| EP | 2232155 | B1 | 12/2019 |
| JP | 2003269779 | A * | 9/2003 |
| WO | 2022200591 | A1 | 9/2022 |

OTHER PUBLICATIONS

Extended European Search Report received for EP Application No. 23211308.4, mailed on Jul. 24, 2024, 14 Pages.

* cited by examiner

MODULAR HVAC-SHW SYSTEM AND A METHOD OF INTEGRATING THEREOF

CROSS-REFERENCE TO RELATED APPLICATION

This patent application claims the benefit of U.S. Provisional Patent Application No. 63/384,515, filed on Nov. 21, 2022, which is incorporated by reference herein in its entirety.

BACKGROUND

This invention relates to the field of heating, ventilation, and air conditioning (HVAC) systems and sanitary or domestic hot water (SHW/DHW) systems, and more particularly, a modular HVAC-SHW/DHW system for buildings and a method of integrating existing HVAC and SHW/DHW systems of buildings.

Mid-scale buildings such as hotels, motels, housing facilities, hospitals, condominiums, apartment buildings, add-on rooms, and sunrooms, are traditionally installed with packaged terminal air conditioners (PTACs) to cool the rooms of the building. These PTACs may be ductless, through-the-wall HVAC systems, however, there is lack of energy recovery in PTACs. In addition, sanitary or domestic hot water (SHW/DHW) systems are also installed in the buildings to provide hot water, but SHW/DHW systems are typically fossil fuel-based gas boilers that may not align with customer sustainable goals.

Owners of such buildings may face retrofitting their existing building stack to meet internal sustainability targets, code-driven ventilation requirements, and growing restrictions on the use of fossil fuel-based heating. Centralized dedicated outdoor air systems (DOAS) may also be employed as HVAC systems in the buildings, but they are expensive to retrofit in the building. This fragmented design of HVAC systems and SHW/DHW systems in buildings does not align with sustainability goals or construction efficiencies.

SUMMARY

Described herein is a modular HVAC-SHW/DHW system ("system") with integrated ventilation for buildings, which provides comfort conditioning, sanitary hot water, and ventilation in the building, and enables the exchange of recovered heat between HVAC and SHW/DHW loads (units) and is also capable of being easily and economically retrofitted in the buildings. The system comprises a heating, ventilation and air conditioning (HVAC) unit configured in an area of interest (AOI), a sanitary or domestic hot water (SHW/DHW) unit configured in the AOI; and an air-to-water heat pump (AWHP) unit fluidically connected to the HVAC unit and the SHW/DHW unit through a water-to-water heat pump (WWHP), wherein the AWHP unit is configured to enable the exchange of heat between environment and the WWHP, and the WWHP is configured to enable the exchange of heat between any of the AWHP unit, the HVAC unit, and the SHW/DHW unit.

In one or more embodiments, the system comprises a heat storage unit configured between the WWHP and the SHW/DHW unit, wherein the heat storage unit comprises one or more of a phase-changing material, and a water tank that is adapted to store heat provided by the WWHP and transfer the stored heat to the SHW/DHW unit.

In one or more embodiments, the system comprises a set of conduits connected between the AWHP unit and the WWHP, the WWHP and the HVAC unit, the WWHP and the SHW/DHW unit, and the ERV and the HVAC unit, to fluidically and thermally connect the AWHP unit with the WWHP, the WWHP with the HVAC unit, the WWHP with the SHW/DHW unit, and the ERV with the HVAC unit.

In one or more embodiments, the system comprises a set of valves configured in the set of conduits to control the flow rate and direction of fluid between the AWHP unit and the WWHP, the WWHP and the HVAC unit, the WWHP and the SHW/DHW unit, and the ERV and the HVAC unit.

In one or more embodiments, the system comprises a set of temperature sensors configured with the AWHP unit, the WWHP, the HVAC unit, the SHW/DHW unit, and the thermal storage unit to monitor the temperature of the fluid across the system and monitor the temperature of the AOI, and a set of flow meters to monitor the flow rate and the direction of the fluid through the set of conduits.

In one or more embodiments, the system comprises a controller in communication with the set of temperature sensors, and relative humidity sensors, wherein the controller is configured to actuate at least one of the valves to enable the exchange of heat between one or more of the environments, the HVAC unit, and the SHW/DHW unit, to facilitate maintaining predefined temperatures in the room, and of the water supplied by the SHW/DHW unit.

In one or more embodiments, the system comprises an energy recovery ventilator (ERV) or a heat recovery ventilator (HRV) configured with the HVAC unit, where the ERV or HRV is operable to provide pre-conditioned ventilated air to the HVAC unit to keep the AOI pressurized at a predefined pressure.

In one or more embodiments, one or more components of the system comprising the HVAC unit, the SHW/DHW unit, the WWHP unit, the thermal storage unit, and the ERV or HRV are packaged within a single housing, and wherein the housing is adapted to be installed at a predefined position at the AOI, and wherein the AWHP unit is outside the AOI.

In one or more embodiments, the predefined position comprises one or more of: above a door in the AOI, wherein the packaged system is in a horizontal configuration, and against a wall in the AOI, wherein the packaged system is in a vertical configuration.

In one or more embodiments, the system comprises an occupancy sensor positioned in the AOI and configured to detect the presence of occupants in the AOI, wherein the ERV or HRV is operatively coupled to the occupancy sensor and the controller, wherein upon detection of the presence of occupants in the AOI, the controller operates the ERV or HRV to supply pre-conditioned ventilated air to the HVAC unit.

In one or more embodiments, the heat rejected by the HVAC unit into the WWHP unit is supplied to the SHW/DHW unit or is supplied back to the HVAC unit to provide reheat for the HVAC unit.

In one or more embodiments, the system comprises a heat storage unit adapted to store heat or cold water provided by the WWHP unit and transfer the stored heat or cold water to the HVAC unit based on the cooling and heating requirement of the HVAC unit.

In one or more embodiments, the system comprises a three-way control valve configured between the WWHP unit, an ambient loop (AL) return line, and AL supply line, wherein the AL supply line and the AL return line are fluidically connected between the AWHP unit and an ambient water flow of the AOI, wherein, the three-way control valve is actuated to select source water from the AL supply line or the AL return line based on temperatures to produce optimum operational efficiency.

Also described herein is a modular HVAC-SHW/DHW system comprising one or more heating, ventilation, and air conditioning (HVAC) units configured in one or more areas of interest (AOI). The system further comprises a first set of water-to-water heat pumps (WWHP) fluidically connected to each of the HVAC units, such that there being at least one of the first WWHP fluidically connected to one of the HVAC units. The system further comprises one or more sanitary or domestic hot water (SHW/DHW) units configured in the one or more AOI; a second set of WWHPs fluidically connected to each of the SHW/DHW units, such that there being at least one of the second WWHP fluidically connected to one of the SHW/DHW units. Each of the second WWHPs is further fluidically connected to each of the first WWHPs, which allows the exchange of heat between the first set of WWHPs and the second set of WWHPs. Further, the system comprises one or more air-to-water heat (AWHP) units, each fluidically connected to the first set of WWHPs and the second set of WWHPs, wherein the AWHP units are configured to enable the exchange of heat between environment and one or more of the first set of WWHPs and the second set of WWHPs to enable the exchange of heat between one or more of the environments, the one or more HVAC units, and the one or more SHW/DHW units.

In one or more embodiments, the system comprises an energy recovery ventilator (ERV) or a heat recovery ventilator (HRV) configured with each of the HVAC units, where the ERV or HRV is operable to provide pre-conditioned ventilated air to each of the HVAC units to keep the one or more AOI pressurized at a predefined pressure.

In one or more embodiments, the ERV or HRV supplies pre-conditioned ventilated air to the rooms in which occupants are present and restrict the supply of pre-conditioned ventilated air to the rooms in which occupants are not present.

In one or more embodiments, the heat rejected by the HVAC units into the corresponding first WWHP units is supplied to the one or more SHW/DHW units or to the one or more HVAC units to provide reheat for the corresponding HVAC units.

In one or more embodiments, the HVAC unit, the SHW/DHW unit, the WWHP unit, the thermal storage unit, and the ERV or HRV associated with each of the one or more AOI are packaged within a single housing, wherein the each of the housing is adapted to be installed at predefined positions in horizontal or vertical configuration in the one or more AOI selected from rooms, above doors, below a floor, on the floor, halls, walls, ceiling, corridors, staircases, basement, and storage spaces associated with a building.

Also described herein is a method of integrating existing or newly installed HVAC and SHW/DHW loads (units) of a building in a modular, efficient, and cost-effective way is disclosed, which provides comfort conditioning, sanitary hot water, and ventilation in the building, and enables the exchange of recovered heat between the HVAC and SHW/DHW loads of the building. The method involves at least one WWHP and one or more AWHP. The method comprises the step of fluidically connecting the one or more HVAC units and the one or more SHW/DHW units associated with the building with each other, and with the one or more AWHP units via at least one WWHP unit. The AWHP units are configured to thermally connect at least one WWHP to the environment. The method further comprises the step of enabling a controlled flow of fluid between the AWHP units, the at least one WWHP, the HVAC units, and the SHW/DHW units, which allows the exchange of heat between one or more of the environments, the AWHP units, the WWHP, the HVAC units, and the SHW/DHW units, thereby facilitating in maintaining predefined temperatures in the one or more AOIs, and of the water supplied by the SHW/DHW units in the one or more AOIs.

In one or more embodiments, the method comprises the steps of storing the heat provided by the at least one WWHP in a heat storage unit comprising a phase-changing material, and transferring the stored heat to the SHW/DHW units and/or to the HVAC units for reheating the HVAC units.

In one or more embodiments, the method comprises the steps of storing cold water or heat generated by the WWHP units in a buffer tank, and transferring the stored cool water or stored heat to the HVAC units based on the cooling and heating requirements of the HVAC unit.

In one or more embodiments, the method comprises the steps of supplying pre-conditioned ventilated air, by an ERV or HRV, to the one or more AOI when at least one occupant is present in the corresponding AOI.

Accordingly, this invention (system and method) enables the exchange of recovered or rejected heat between HVAC and SHW/DHW units in the building, thereby efficiently utilizing and distributing the recovered or rejected heat in the system and also providing comfort conditioning, sanitary hot water, and ventilation in the building. This makes the invention energy-efficient and reliable, and also reduces carbon footprint.

The system is designed in a packaged form factor or modular design, where the components/units of the system are configured within a housing that is compact and easily installable at a desired location in the building. The locations can be but are not limited to rooms, entry hall, above doors, below a floor, on the floor, ceiling, walls, corridors, staircases, basement, and storage spaces associated with the building. For instance, the packaged system/housing can be designed in a horizontal orientation/configuration on each floor above the door in entry hall or in the corridors, and/or designed in a vertical orientation/configuration in wet chase risers or at exterior walls, and/or designed to be horizontally or vertically fitted in a closet, and/or configured vertically against the outer wall, but not limited to the like.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

Figure 1A:
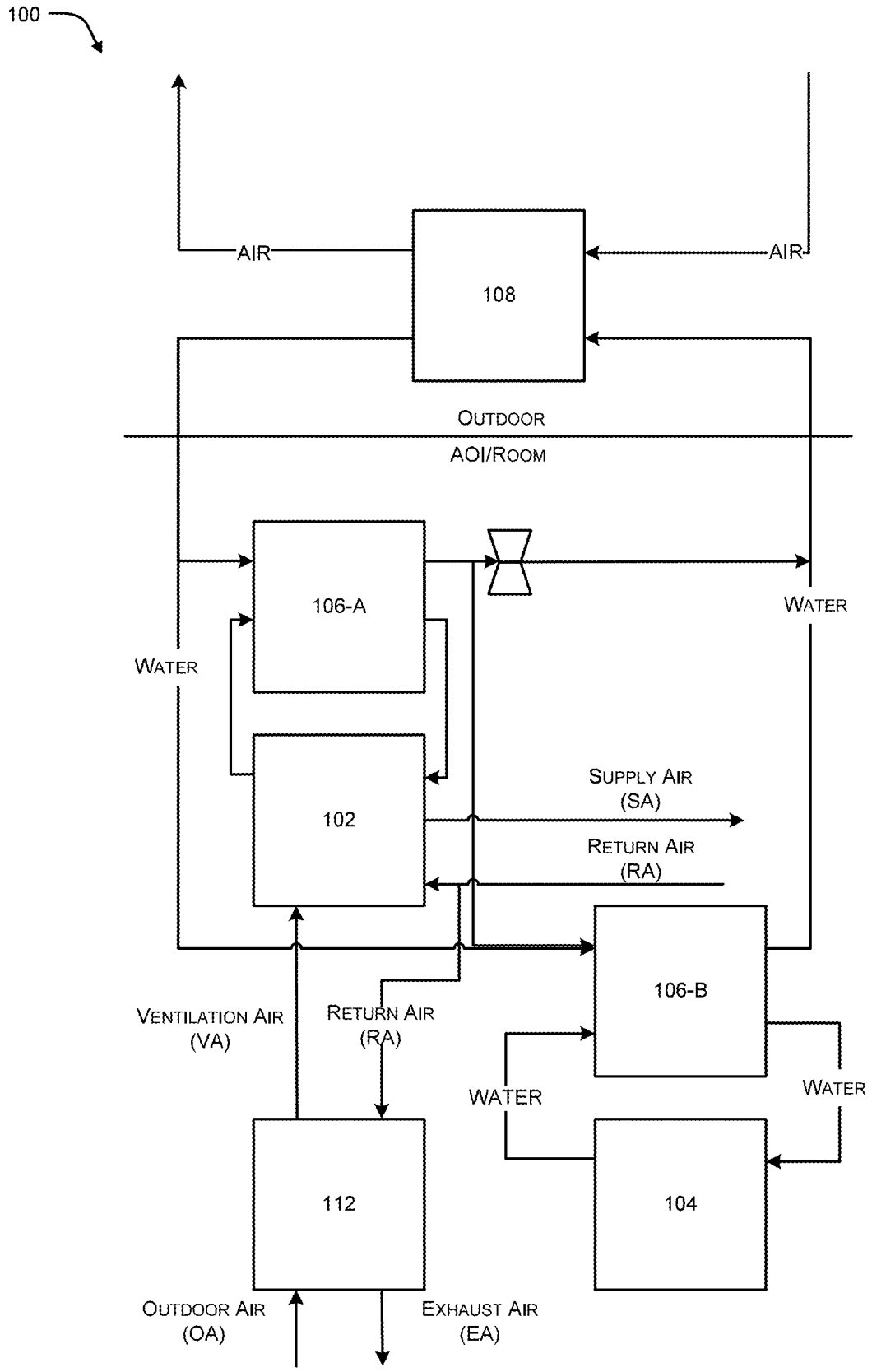
FIG. 1A is a block diagram illustrating an exemplary embodiment of a modular HVAC-SHW/DHW system implemented in a room of a building in accordance with one or more embodiments of the invention.
Figure 3:
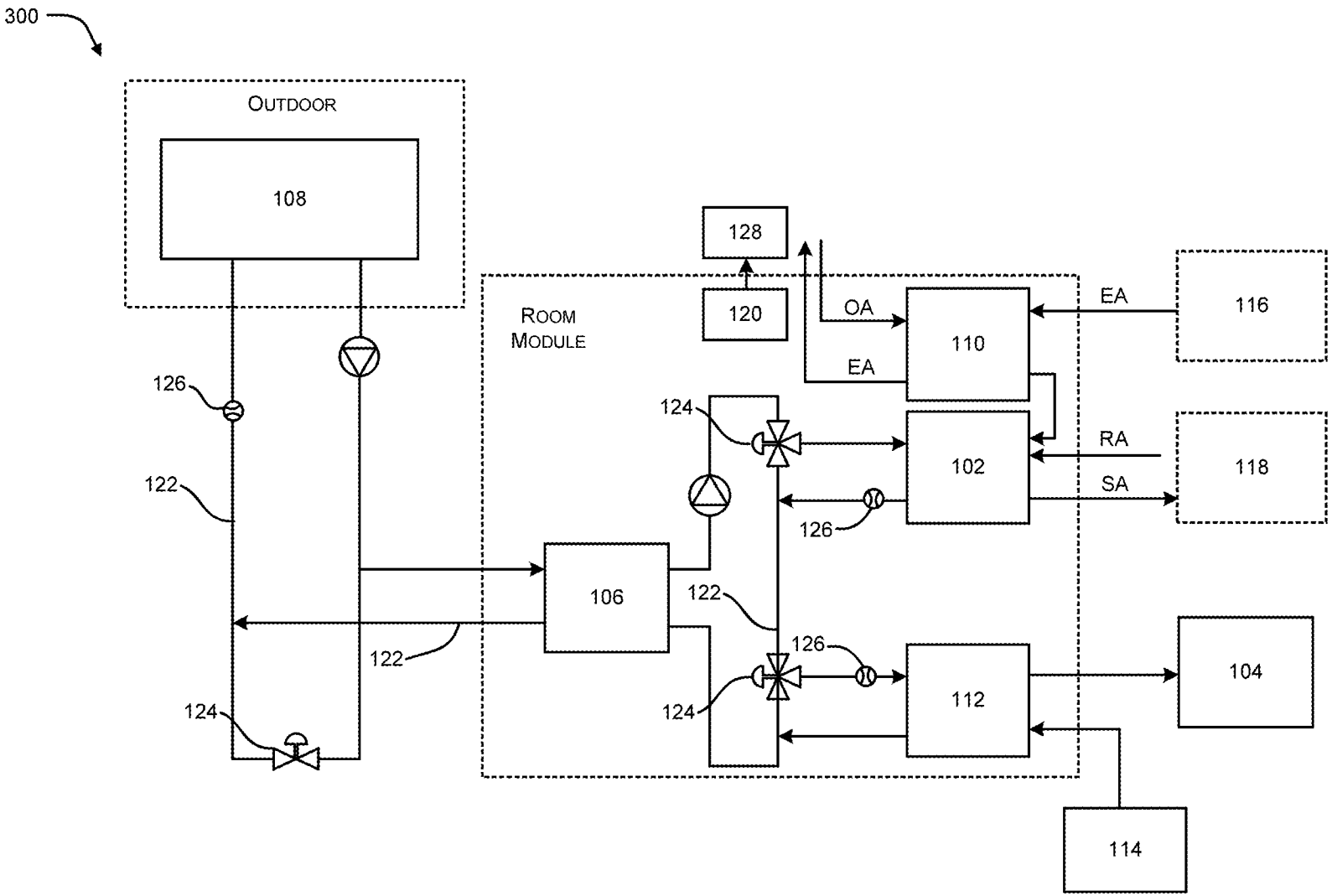
FIG. 3 is a block diagram illustrating another exemplary embodiment of the system involving a heat storage medium at the SHW/DHW end, being implemented in a room of a building in accordance with one or more embodiments of the invention.
Figure 4:
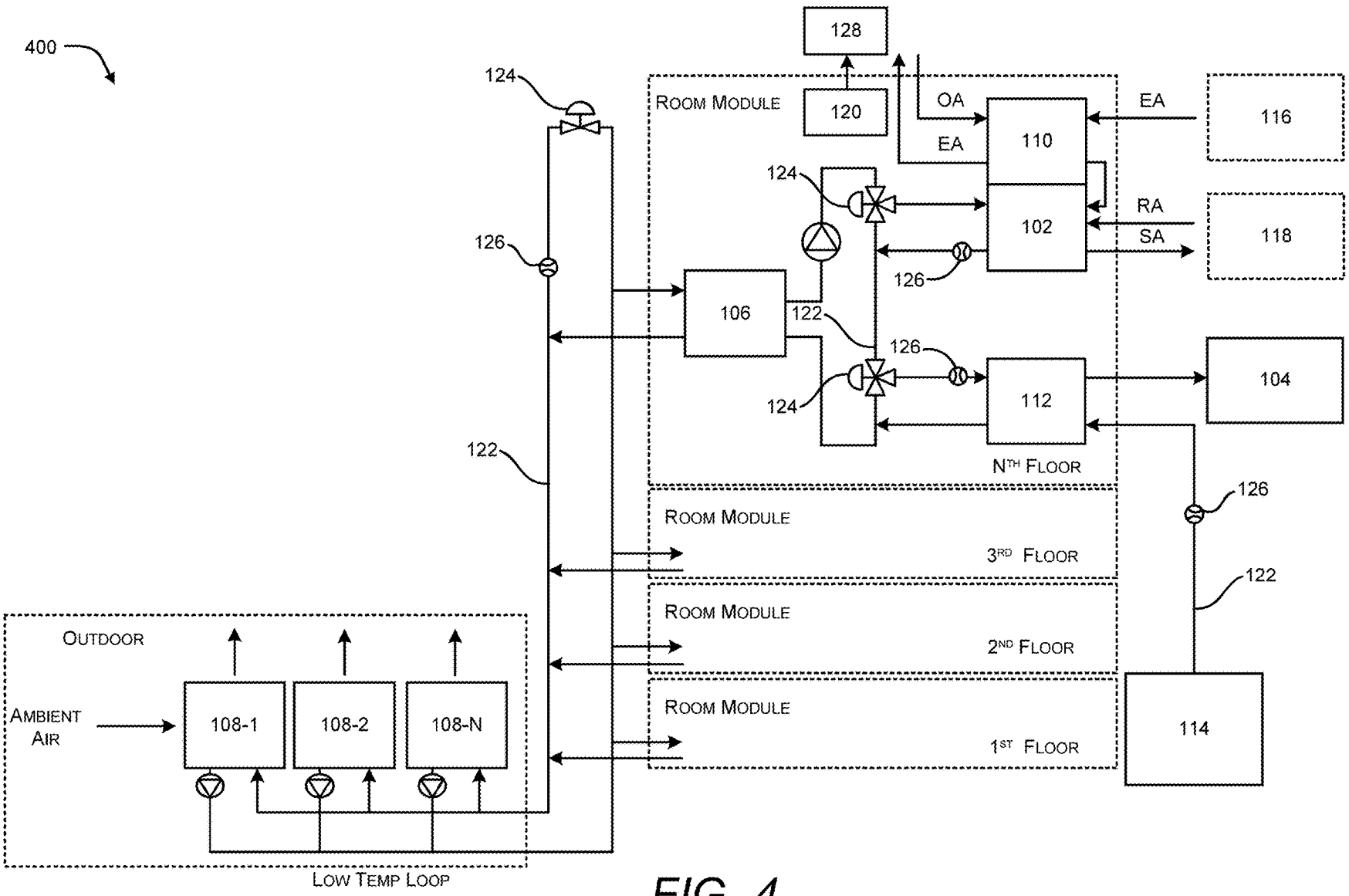
FIG. 4 is a block diagram illustrating an exemplary embodiment of the system implemented in multiple rooms of a building and involving a common heat pump for the HVAC and SHW/DHW units in accordance with one or more embodiments of the invention.
Figure 5:
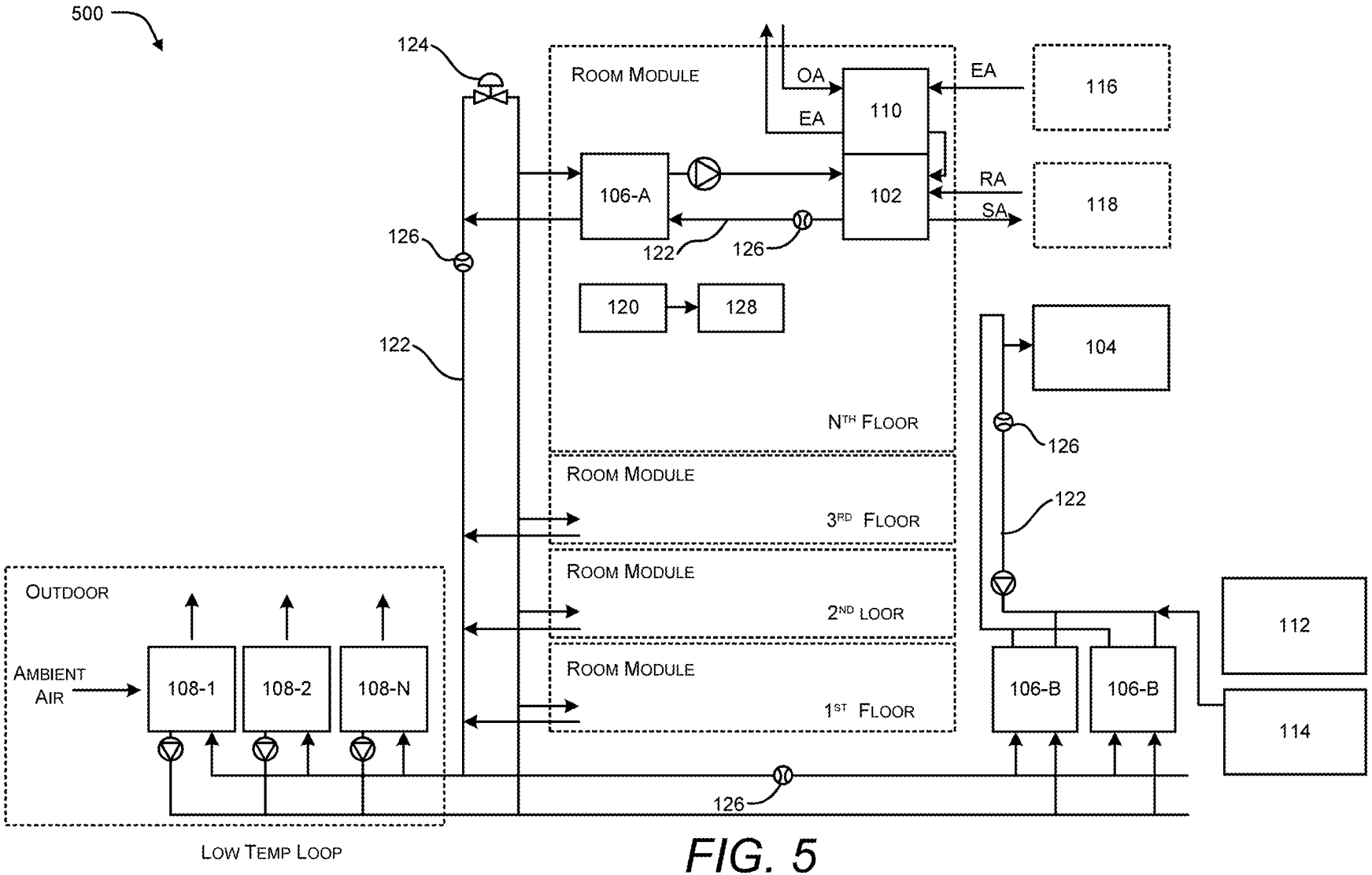
FIG. 5 is a block diagram illustrating another exemplary embodiment of the system implemented in multiple rooms of a building and involving different heat pumps for the HVAC and SHW/DHW units in accordance with one or more embodiments of the invention.

Existing fragmented design of HVAC systems and SHW systems in buildings does not align with sustainability goals or construction efficiencies. Besides, there is no option for heat recovery between the HVAC systems and the SHW systems of the buildings, which generally go unutilized. There is, therefore, a need to provide a modular HVAC-SHW system with integrated ventilation, which provides comfort conditioning, sanitary hot water, and ventilation in the building, enabling the exchange of recovered heat between HVAC and SHW loads, and can be easily and economically retrofitted in the buildings Referring to FIGS. 1A to 5, the modular HVAC-SHW/DHW system "system" 100 for buildings is disclosed. The system 100 includes one or more HVAC units 102 (collectively referred to as HVAC units 102 and individually referred to as HVAC unit 102, herein) and one or more sanitary or domestic hot water (SHW/DHW) units 104 (collectively referred to as SHW/DHW units 104 and individually referred to as SHW/DHW unit 104, herein) configured at predefined positions at one or more locations/areas of interest (AOI) in a building. In some embodiments, the SHW unit 104 of this invention can be a direct consumption fixture such as but not limited to a faucet or shower head as shown in FIGS. 3 to 5. Further, in other embodiments, the SHW/DHW unit 104 can be an SHW/DHW storage device that can either be a water tank or thermal storage, which can be further fluidically connected to the fixtures as shown in FIGS. 1 to 2B. The system 100 includes at least one water-to-water heat pump (WWHP) 106-A, 106-B (collectively referred to as WWHPs 106 and individually referred to as WWHP 106, herein) fluidically connected to the HVAC units 102 and/or the SHW/DHW units 104. For instance, in one embodiment, a first set of WWHPs 106-A (also referred to as HVAC WWHP 106-A, herein) can be fluidically connected to each of the HVAC units 102, such that at least one of the first WWHPs 106-A remains fluidically connected to one of the HVAC units 102. Further, a second set of WWHPs 106-B (also referred to as SHW/DHW WWHP 106-B) can be fluidically connected to each of the SHW/DHW units 104, such that at least one of the second WWHPs 106-B remains fluidically connected to one of the SHW/DHW units 104. Besides, in another embodiment, a single WWHP 106 can also be employed, which can be fluidically coupled to the HVAC units 102 as well as the SHW/DHW units 104 of the system. The WWHPs 106 can preferably be of identical size to increase modularity and reduce complexity.

The system 100 further includes one or more air-to-water heat (AWHP) units 108-1 to 108-N (collectively referred to as AWHP units 108 and individually referred to as AWHP unit 108, herein). Each AWHP unit 108 is fluidically connected to the first set of WWHPs 106-A and the second set of WWHPs 106-B, or the common WWHP 106 based on the requirement. These AWHP units 108 are configured to enable the exchange of heat, via thermally conductive fluid, between the environment and any of the first set of WWHPs 106-A and/or the second set of WWHPs 106-B, which correspondingly enables the exchange of rejected or recovered heat between the environment (ambient air), the HVAC units 102, and/or the SHW/DHW units 104. In some embodiments, the AWHP units 108 are also used as a WWHP or a ground source heat pump (geothermal heat pump), which enables the exchange of heat between the ground (earth) and any of the first set of WWHPs 106-A and/or the second set of WWHPs 106-B, which correspondingly enables the exchange of heat between the ground, the HVAC units 102, and/or the SHW/DHW units 104.

The number of WWHPs and AWHP units involved in this system 100 can be based on the quantity, size, and location of the HVAC units and SHW units used in the building, and based on individual facility requirements, without any limitations, and all such embodiments are well within the scope of this invention.

System 100 includes a thermal storage unit 112 configured between the WWHPs 106-B and the SHW/DHW units 104, and/or between the HVAC WWHP 106-A and the HVAC unit 102. In some embodiments, the thermal storage unit 112 includes a phase-changing material (PCM) or water, which is configured between the WWHPs 106-B and the SHW/DHW units 104. The PCM 112 is adapted to store heat provided by the WWHP 106-B and transfer the stored heat to the SHW/DHW unit 104 when required. The system also includes a potable makeup water source 114 fluidically connected to the thermal storage unit to provide additional water to the thermal storage unit 112 when required. The potable makeup water source 114 also provides additional water in the conduits 122 of the system to provide a sufficient amount of water in the SHW/DHW unit 104.

In some embodiments, the thermal storage unit 112 includes a buffer tank configured with the HVAC unit 102. The buffer tank is generally an insulated tank that is being installed right after the HVAC WWHP 106-A of the HVAC unit 102. The buffer tank collects the cold water that is produced by the HVAC WWHP 106-A, in order to pump cool water from the buffer tank to the HVAC unit 106-A, thereby ensuring a constant and regular flow of cool water to the HVAC unit 106-A. Besides, the buffer tank is also be used to store the rejected heat of the HVAC unit 102, which can be later utilized during the heating season. The storage of the buffer tank depends on the total quantity of the circulated water in the system and on the nominal cooling capacity of the system.

Further, the system 100 includes an energy recovery ventilator (ERV) or heat recovery ventilator (HRV) 110 configured with each of the HVAC units 102 in the rooms/AOI. The ERV/HRV 110 provides pre-conditioned ventilated air to the corresponding HVAC unit 102 to keep the room/AOI positively pressurized at a predefined pressure. In some embodiments, the HVAC unit 102 includes an air terminal that can be fan-powered, or an induction unit driven by the ERV or HRV 110 to increase ventilation, efficiency, and thermal comfort with a reduced noise footprint.

This system 100 is designed in a packaged form factor or modular design that can be easily retrofitted at desired locations in the building. The locations include but are not limited to rooms, corridors, staircases, basement, and storage spaces associated with the building. For instance, the system can be designed for horizontal distributions on each floor in the corridors. The system can also be designed for vertical distributions in wet chase risers. Further, the system can also be designed to be horizontally or vertically fitted in a closet, and/or configured vertically against the outer wall, but not limited to the like.

Figure 1B:
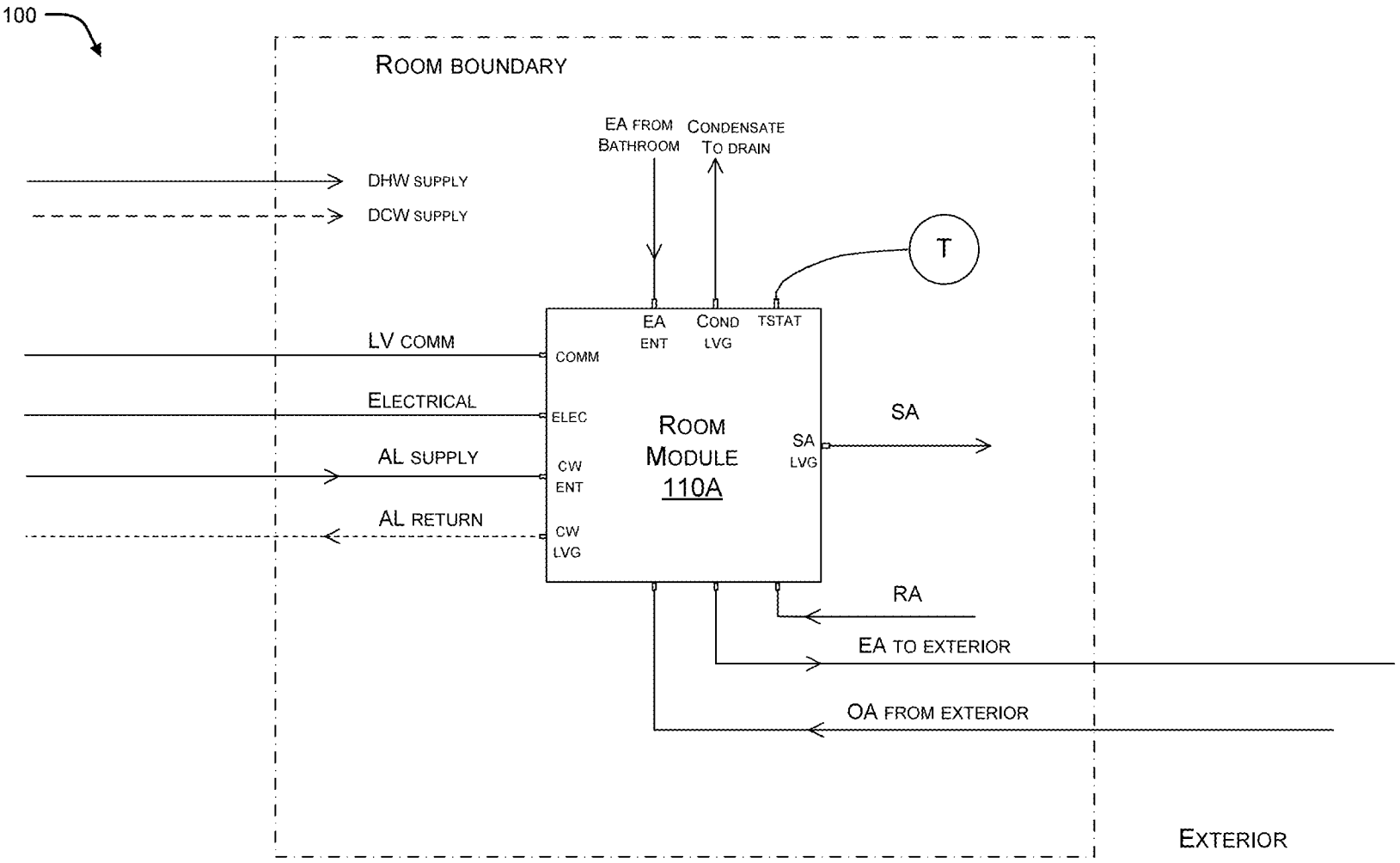
FIG. 1B is a schematic illustrating a room of a building configured with the system of FIG. 1A, wherein the system is packaged as a room module in accordance with one or more embodiments of the invention.
Figure 1C:
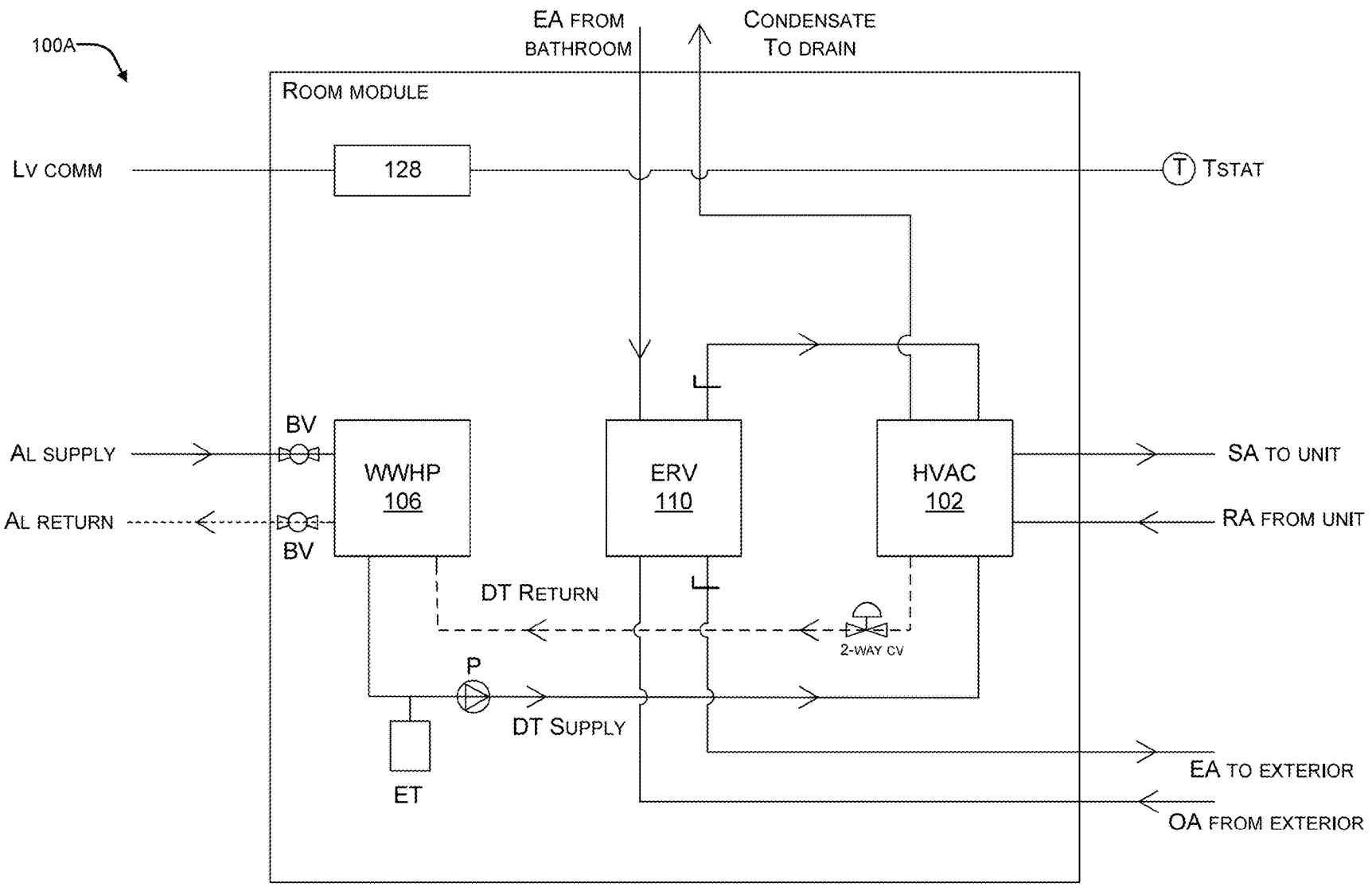
FIG. 1C is a schematic of the room module of FIG. 1B in accordance with one or more embodiments of the invention.

Referring to FIGS. 1B and 1C, the system 100 can be packaged in form of a room module 100A that can be easily retrofitted at desired locations a room. The room module 100A can include at least the HVAC unit 102, the WWHP 106, and the ERV/HRV 110 associated with the system 100, however, the AWHP unit 108 remains outside of the room module 100A. The WWHP 106 can be fluidically connected to the outside AWHP 108 using an ambient loop comprising a first set of conduits fitted with a balancing valve (BV). Further, the HVAC unit 102 can be fluidically connected to the WWHP 106 using a dual temperature (DT) loop, where a DT supply line (conduit) can be configured with a pump (P) (configured with a variable frequency drive (VFD)) to supply fluid from the WWHP into the HVAC unit, and a DT return line can be configured with a two-way motorized control valve (CV) to return the fluid back to the WWHP 106. Any condensate from the HVAC unit 102 can be transferred to a drain outside the room module 100A. In addition, an expansion tank (ET) can also be configured with the DT supply line. Further, the ERV/HRV 110 can be operable to receive exhaust air (EA) from bathroom and outside air (OA) via a second set of conduits, and accordingly provide pre-conditioned ventilated air to the HVAC unit 102 to keep the room pressurized at a predefined pressure. Furthermore, the room module 100A can include a thermostat (T) or sensors to monitor the temperature and humidity of the room.

The components of the system are fluidically connected to one another by a set of conduits (pipes) 122 connected between the AWHP units 108 and the WWHPs 106, the WWHPs 106-A and the HVAC units 102, the WWHPs 106-B and the SHW units, the ERVs or HRVs 110 and the HVAC units 102, and the thermal storage unit 112 and the potable makeup water 114. The conduits 122 can be the existing conduits of the building, which connect the already installed HVAC units 102 and SHW units/DHW 104 of the building. Additionally, additional conduits may also be employed to connect the existing HVAC units and SHW units with the AWHP units and the WWHPs, and to further connect newly installed HVAC units, SHW units, and other components of the system with each other. The system further includes a set of valves 124, which can be unidirectional or multi-directional configured in the set of conduits 122 to control the flow rate and direction of flow of associated fluid (water or air) between the AWHP units 108 and the WWHPs 106, the HVAC WWHPs 106-A and the HVAC units 102, the SHW/DHW WWHPs 106-B and the SHW/DHW units 104, the ERVs or HRVs 110 and the HVAC units 102, and/or the thermal storage unit 112 and the potable makeup water source 114.

The conduits 122 fluidically and thermally connect the AWHP units 108 with the WWHPs 106, the WWHPs 106 with the HVAC units 102, the WWHPs 106 with the SHW/DHW units 104, the ERVs or HRVs with the HVAC units 102, and the thermal storage unit 112 and the potable makeup water source 114. The conduits 122 allow the fluid such as water to flow and transfer heat between the HVAC WWHPs 106-A and the HVAC units 102, the SHW/DHW WWHPs 106-B and the SHW/DHW units 104, and the AWHP units 108 and the WWHPs 106-A, 106-B. Further, the conduits 122 allow the fluid such as air to flow and transfer heat between the environment and the AWHP units 108, and the ERVs or HRVs 110 and the HVAC units 102.

In one or more embodiments, the system may include a set of flow meters 126 connected with the set of conduits 122 of the system to monitor the flow rate and the direction of the fluid through the set of conduits 122. In addition, in one or more embodiments, the system may include a set of sensors 120 to monitor the temperature and humidity of the rooms/AOI, the temperature of the fluid flowing through the conduits 122, and detect the presence of occupants in the rooms/AOI. The set of sensors 120 may be positioned at predefined locations comprising one or more of walls, entry hall, ceiling, corridors, staircases, basements, washrooms, toilet, storage spaces, and the like, associated with the rooms/AOI. Further, the sensors 120 may be positioned within components of the system which may include one or more of the set of conduits 122, the AWHP units 108, the WWHPs 106, the HVAC units 102, the SHW/DHW units 104, and the thermal storage unit 112. In one or more embodiments, sensors 120 may include a temperature sensor configured with the set of conduits 122, the AWHP units 108, the WWHPs 106, the HVAC units 102, the SHW/DHW units 104, and the thermal storage unit 112, to monitor the temperature of the fluid across the system and monitor the temperature of the rooms and/or of the water supplied by the SHW/DHW units 104. Further, in one or more embodiments the set of sensors 120 may include a relative humidity sensor positioned in the AOI/rooms to monitor the humidity of the rooms. Furthermore, in one or more embodiments, the set of sensors 120 may include an occupancy sensor positioned in the rooms/AOI to detect the presence of occupants in the rooms/AOI.

The system includes a controller 128 in communication with the flow meters 126, and the set of sensors 120 (e.g., the temperature sensors, relative humidity sensors, the occupancy sensors, and/or other sensors). The controller 128 is also operatively coupled to the set of valves 124, as well as the AWHP units 108, the WWHPs 106, the HVAC units 102, the SHW/DHW units 104, and the ERVs or HRVs 110. The controller 128 is configured to receive the data captured by the flow meters 126, and the set of sensors 120 (temperature sensors, relative humidity sensors, and occupancy sensors). The controller 128 is further configured to actuate at least one of the valves 124 to enable the exchange of heat between any or a combination of the environment, the HVAC units 102, and the SHW/DHW units 104, to facilitate maintaining predefined temperatures in the room, and of the water supplied by the SHW/DHW units 104. In addition, once the occupancy sensor detects the presence of occupants in the room(s)/AOI, the controller 128 operates the ERV or HRV 110 to supply pre-conditioned ventilated air to the HVAC unit. The controller 128 also controls the operation of the AWHP units 108, the WWHPs 106, the HVAC units 102, the SHW/DHW units 104, and the ERVs or HRVs 110 in the system.

Figure 8:
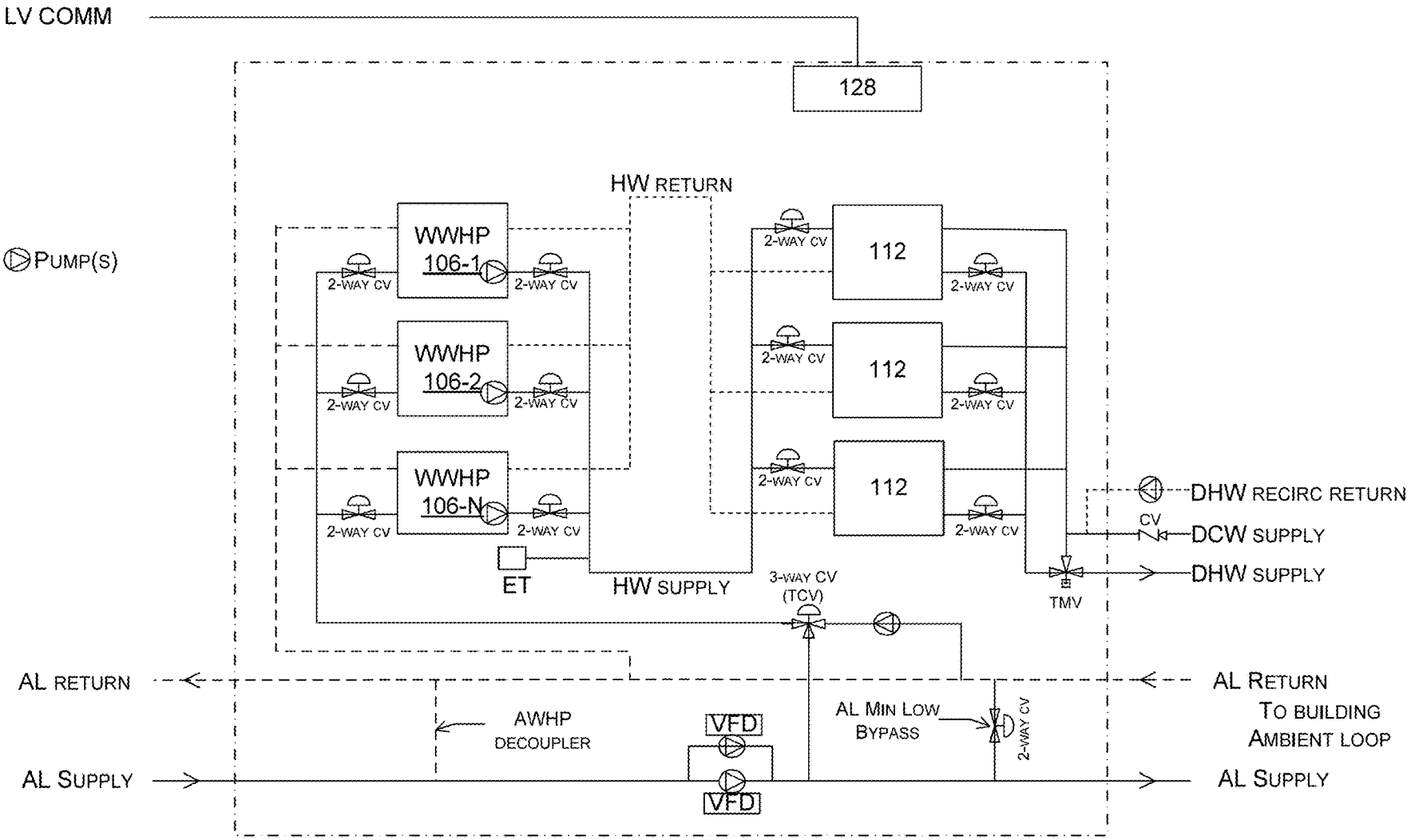
FIG. 8 illustrates a schematic of the piping and pumping architecture of the system in accordance with one or more embodiments of the invention.

Referring to FIG. 8, a schematic of the piping architecture of the system is disclosed. As illustrated, each WWHPs 106 associated with the system 100 can be fluidically connected to SHW/DHW units 104 (as shown in FIGS. 2A to 5) of the system using one or more hot water (HW) supply lines and HW return lines. In addition, a thermal storage unit or PCM 112 can also be configured between the WWHPs 106 and the SHW/DHW units 104, however, the WWHPs 106 can be directly connected to the SHW/DHW unis 104 without the thermal storage 112. Further, a two-way control valve (CV) and a check valve can be configured in the HW supply lines to facilitate flow of domestic cold water (DCW) from the SHW/DHW units 104 to the WWHPs 106 and further facilitate flow of domestic hot water (DHW) from the WWHPs 106 to the SHW/DHW units 104. Furthermore, a thermostatic mixing valve (TMV) can also be configured in the DCW line and the DHW line.

The WWHPs 106 can be fluidically connected to AWHP units 108 that are outside the building/AOI as well as to the ambient water flow that is within the building. An ambient loop (AL) supply line can extend between the AWHP units 108 and the ambient loop water flow of the building to supply water from the AWHP units 108 to the ambient loop water flow within the AOI/building. In addition, an AL return line can supply water from the ambient loop water flow of the building to the AWHP units 108. Further, a decoupler can be used to fluidically isolate/decouple the AWHP from the ambient loop.

In addition, a three-way control valve (TCV) can be configured between the AL return line, the AL supply line, and the WWHPs 106 to control the flow of water from the AWHP units and/or the AL water flow of the building to the outdoor coils of the WWHPs 106. A first port of the TCV can be connected to the AL supply line via a first pump, a second port of the TCV can be connected to the AL return line via a second pump, and a third port of the TCV can be connected to the WWHPs via one or more two-way control valves. In addition, variable frequency drives (VFDs) can be further configured with each of the pumps. Further, the three-way control valve can be actuated to select source water from the AL supply line or the AL return line based on temperatures to produce optimum operational efficiency In one or more embodiments, in a cooling dominant mode or season, the TCV can be actuated by the controller to divert warmest possible water from the AL water flow of the building to the WWHPs 106 as the water supplied by the AWHP unit 108 may be much colder compared to the AL water flow of the building. Further, in one or more embodiments, in a heating dominant mode or season, when the AWHP unit 108 is supplying the hottest water to the building, the TCV can be actuated by the controller to first divert the hottest possible water from the AWHP unit 108 to the WWHPs 106 and then from the AL supply of the building. Thus, the selection of the AL supply line or the AL return line based on temperatures during cooling dominant season and heating dominant season can enable the system to achieve optimum operational efficiency.

Figure 9:
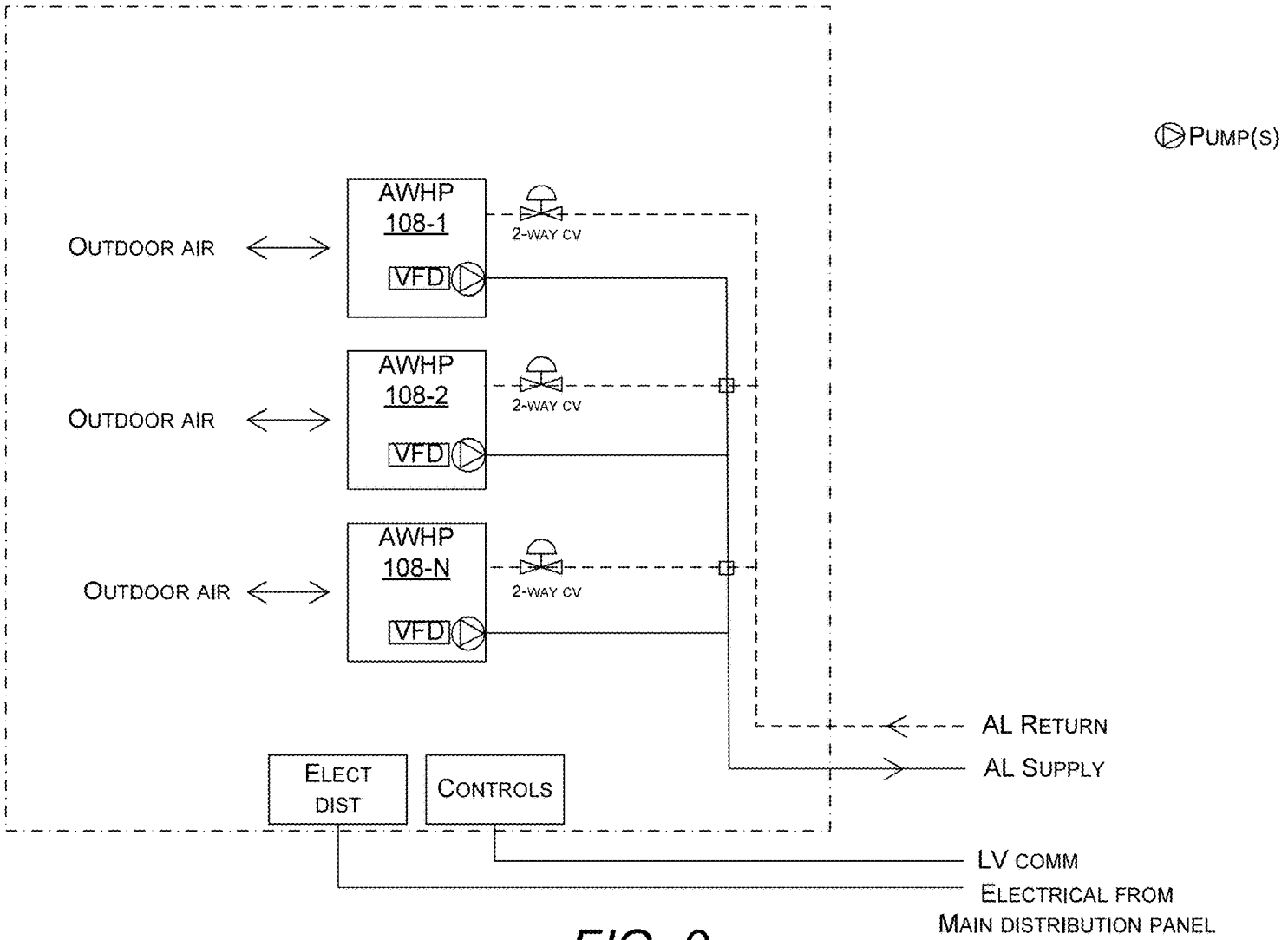
FIG. 9 illustrates an AWHP schematic of the system in accordance with one or more embodiments of the invention.

Referring to FIG. 9, an AWHP schematic of the system is disclosed. As illustrated, the AWHP units 108-1 to 108-N can be fluidically connected to the AL return line via a two-way control valve (CV) and to the AL supply line via a pump. Further, the outdoor coils of the AWHP units 108 can be in thermal contact with outside air. The controller can control the actuation of the two-way CV and/or the pumps to control the flow of water between the ambient loop and the AWHP units 108. In addition, a VFD can be further configured with each of the pumps to adjust the operating speed of the pump. Referring to FIG. 1A to 1C, the system 100 implemented in an AOI such as a room of a building is illustrated. System 100 includes an HVAC unit 102 and an SHW/DHW unit 104, and other units that are efficiently packaged in a single housing forming a 'drop-in' modular system 100 that is easily installable at any position in the AOI/room. This modular system 100 can be installed on the floor, below the floor, wall, closet, ceiling, and the like, without any limitation. However, in some embodiments, the HVAC unit 102 and the SHW unit 104, and other units that are also configurable separately at predefined positions in a room. For instance, the HVAC unit 102 can be positioned on the floor or wall or closet, or ceiling inside the room, and the SHW/DHW unit 104 can be configured in the bathroom or toilet associated with the room. Similarly, other possible configurations of the SHW/DHW unit 104 and HVAC unit 102 in the room are also possible, without any limitation. The system 100 further includes an AWHP unit 108 configured outside the room, preferably on the roof of the room or building. The AWHP unit 108 can be fluidically connected to the HVAC unit 102 through a first WWHP 106-A (HVAC WWHP) and the AWHP unit 108 can be fluidically connected to the SHW/DHW unit 104 through a second WWHP 106-B (HVAC WWHP). The WWHPs 106 can be either positioned in the room/bathrooms/toilet or outside the room. The AWHP unit 108, the WWHPS 106, the HVAC unit 102, and the SHW/DHW unit 104 can be connected through a set of conduits 122. These conduits 122 can preferably be configured and extended within the walls of the room, however, the conduits 122 may also extend along the inner walls of the room as well. The system further includes an ERV or HRV 110 configured with the HVAC unit 102 and positioned in the room/AOI. The ERV or HRV 110 is also packaged in the same housing of the modular system 100 along with other units. The ERV/HRV 110 provides pre-conditioned ventilated air to the corresponding HVAC unit 102 to keep the room/AOI positively pressurized at a predefined pressure. The ERV/HRV 110 can receive return air (RA) directly from the room as well as from the HVAC unit 102, and provide pressurized ventilated air to the HVAC unit 102 later providing supply air (SA) in the room. In an embodiment, the rejected heat from the HVAC heat pump 106-A may be used for either recovery to the SHW/DHW unit 104 or be piped to provide reheat for the HVAC unit 102.

Figure 2A:
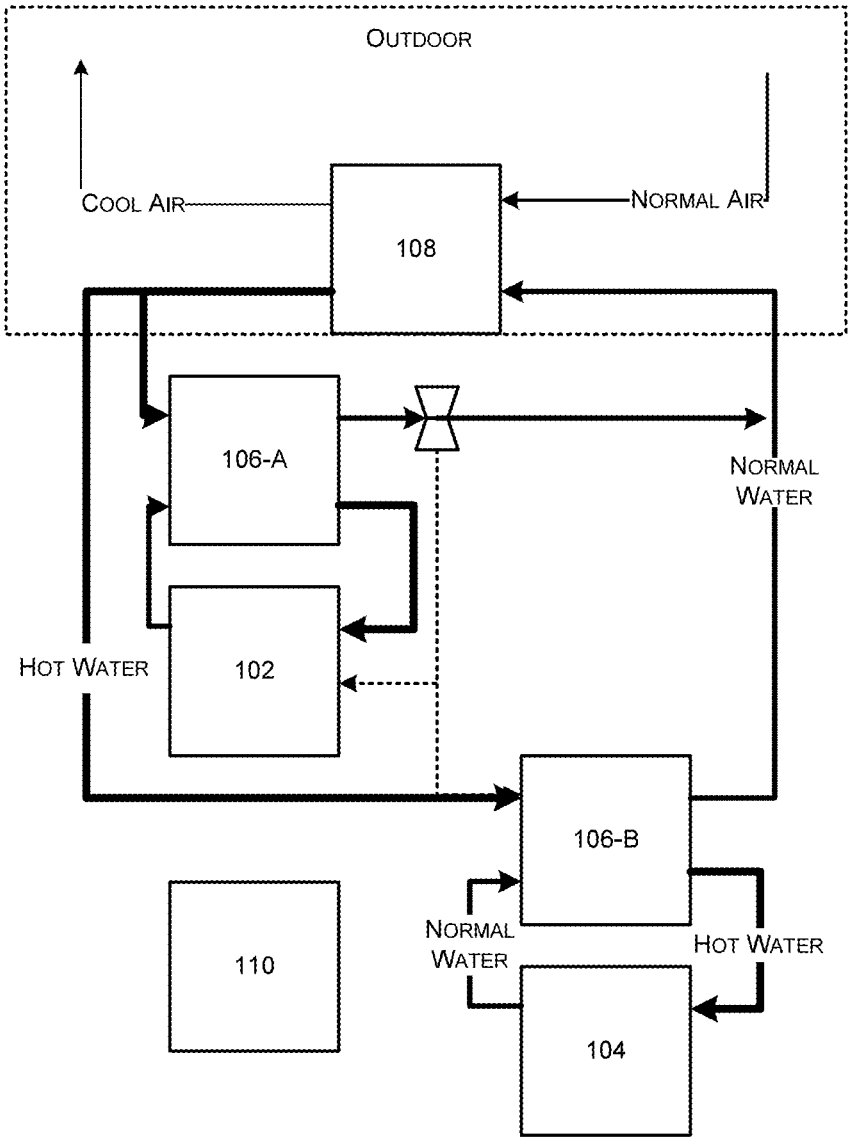
FIG. 2A is a block diagram illustrating the operation of the system of FIG. 1A in the heating season in accordance with one or more embodiments of the invention.
Figure 2B:
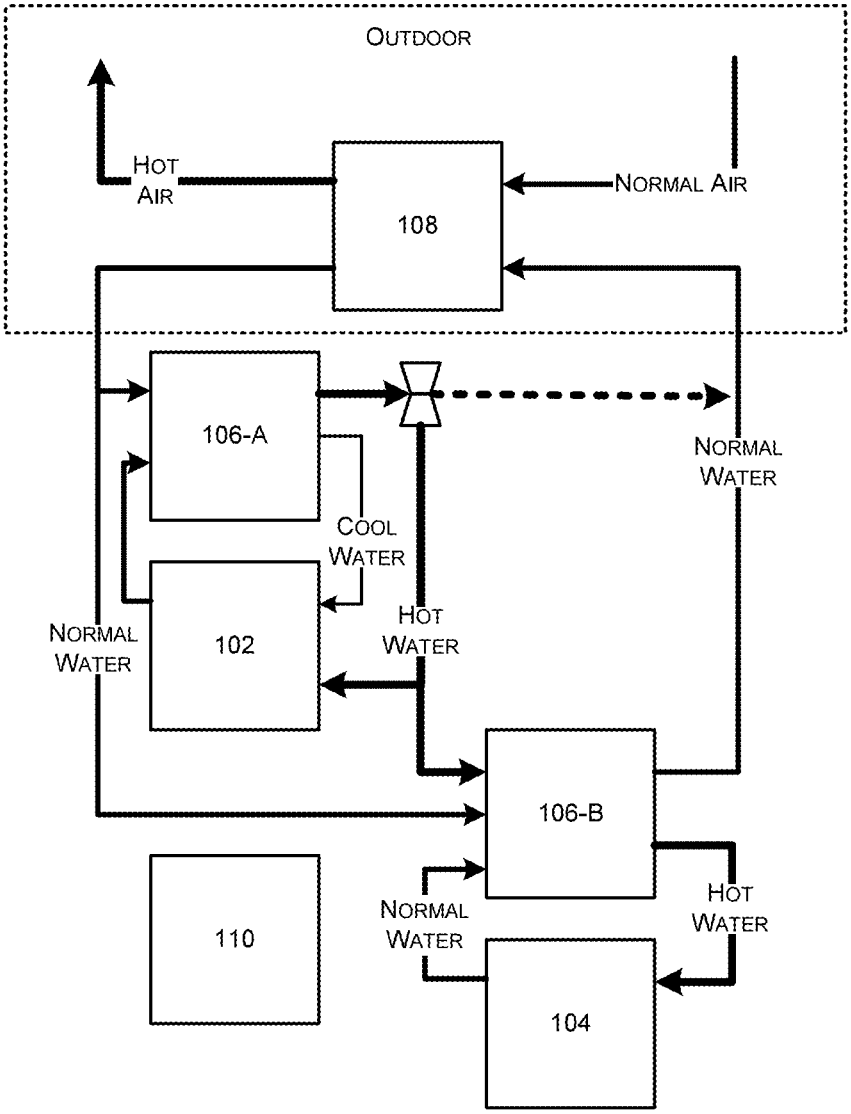
FIG. 2B is a block diagram illustrating the operation of the system of FIG. 1A in the cooling season in accordance with one or more embodiments of the invention.

Referring to FIG. 2A, in HVAC cooling operations, the AWHP unit 108 rejects heat from the common loop into the environmental air, providing a tempered loop for the HVAC WWHP 106-A to provide cooling capacity to the HVAC unit 102 and the SHW/DHW WWHP 106-B to provide heating capacity to the SHW/DHW unit 104. Additionally, the return water from the HVAC WWHP 106-A can be diverted away from the common loop return stream into the SHW/DHW WWHP 106-B supply stream so that the rejected HVAC heat can be recovered in the system into the SHW/DHW unit 104. Further, when no SHW load exists, the return water can be piped and directed back to the common loop through the conduits 122. Referring to FIG. 2A, in HVAC heating operations, the AWHP unit 108 pulls heat into the common loop from the environmental air, providing a tempered loop for the HVAC WWHP 106-A and providing heating capacity to the HVAC unit 102 and the SHW/DHW WWHP 106-B heating to the SHW/DHW unit 104. Further, the HVAC WWHP 106-A and the SHW/DHW WWHP 106-B can be sequenced to operate non-coincidentally when the AWHP unit 108 cannot provide sufficient capacity to serve both loads simultaneously. Further, in some embodiments, as shown in FIG. 3, if additional SHW thermal storage is desired, a thermal storage buffer tank 112 (thermal storage unit), either water or phase change material, can be included in the system 100.

Referring to FIG. 3, in one or more embodiments of this invention, the two separate WWHPs 106 i.e., the HVAC WWHP 106-A and SHW/DHW WWHP 106-B of FIG. 1A can be replaced with a single WWHP 106. One side of the common WWHP 106 can be fluidically connected to the HVAC 102 unit as well as the thermal storage unit 112, and the other side of the common WWHP 106 can be fluidically connected to the AWHP unit 108. The WWHP 106 can be a mini heat pump that can be integrated with the HVAC unit 102 and the thermal storage unit 112 to provide a 'drop-in' modular system 300 that can be easily configured within the room. Additionally, the ERV/HRV unit 110 can be configured with the HVAC unit 102, which can also be integrated with the modular design of system 300. Further, the thermal storage unit 112 includes a phase-changing material or a buffer tank, configured between the common WWHP 106 and the SHW/DHW unit 104, and/or the common WWHP 106 and the HVAC unit 102. The SHW unit 104 of FIG. 3 is a direct consumption fixture such as but not limited to a faucet or shower head (also referred to as SHW fixtures 104, herein) that is adapted to be fluidically coupled to the thermal storage unit 112 of the system 300. The thermal storage unit 112 is adapted to store heat or cold water provided by any of the WWHP 106, and the HVAC unit 102 and later supply the stored heat or cold water back to any of the HVAC unit 102 and/or to the SHW fixtures 104 when required. Further, the thermal storage unit 112 additionally includes a potable makeup water source fluidically connected to the phase changing material (PCM) 112 to provide additional water to the heat storage unit when required. The potable makeup water source 114 can also provide additional water in the conduits 122 of system 300 to maintain a sufficient amount of water as required in the system 300. Further, the ERV or HRV 110 can be connected to an exhaust fan 116 provided in the toilet or bathroom. Referring to FIGS. 4 and 5, the system 400, 500 implemented in multiple rooms of a building is illustrated. The system 400, 500 includes one HVAC unit 102 configured at predefined positions in each room of the building. The system 400, 500 further includes at least one WWHP 106 fluidically connected the HVAC unit 102, which is also provided as a part of the modular package of the system in each room of the building. For instance, in one embodiment, as shown in FIG. 4, a single WWHP 106 can also be employed in each room, which can be fluidically coupled to the HVAC unit 102 of the corresponding room. In another embodiment, as shown in FIG. 5, one WWHP 106-A (HVAC WWHP) can be fluidically connected to the HVAC unit 102 in each room, and one or more SHW heat pumps 106-B can be fluidically connected to the SHW fixtures (faucet or shower head) 104 provided for the corresponding room. The WWHPs 106-A, 106-B can preferably be of identical size to increase modularity and reduce complexity.

The system 400, 500 further includes one or more AWHP units 108-1 to 108-N fluidically connected to the HVAC WWHPs 106-A and the SHW/DHW WWHPs 106-B of each room of the building as shown in FIG. 5, or to the common WWHP 106 of each room of the building as shown in FIG. 4. These AWHP units 108 are configured to enable the exchange of heat between the environment and any of the HVAC WWHPs 106-A, the SWH/DHW WWHPs 106-B, and the common WWHP 106. In some embodiments, as shown in FIG. 5, the SHW/DHW WWHPs 106-B of each room can be directly fluidically connected to the AWHP unit 108 as well as to the HVAC WWHP 106-A. These AWHP units 108 are configured to enable the exchange of heat, via thermally conductive fluid, between the environment and any of the HVAC WWHPs 106-A and/or the SHW/DHW WWHPs 106-B, which correspondingly enables the exchange of rejected or recovered heat between the environment, and the HVAC units 102, and also enables the supply of hot or cold water to the SHW fixtures 104.

The system 400, 500 includes a thermal storage unit 112 involving a phase-changing material (PCM) and/or a buffer tank, which is fluidically configured between the SHW/DHW WWHP 106-B/common WWHP 106 and the SHW fixtures 104 and/or between HVAC WWHP 106-A/common WWHP 106 and the HVAC unit 102, in each room to store rejected heat or cold water and transfer the stored heat or stored cold water back in the system and to the SHW fixtures 104 during the heating season or cooling season. The heat storage unit 112 also includes a potable makeup water source 114 fluidically connected to the PCM 112 to provide additional water to the heat storage unit 112 when required. The potable makeup water source 114 can also provide additional water in the conduits 122 of the system 400, 500 to provide a sufficient amount of water in the SHW fixtures 104. Further, the system 400, 500 further includes the buffer tank configured with the HVAC unit 102 to ensure a constant and regular flow of cold or hot water to the HVAC unit 102. Further, the system 400, 500 includes an ERV or HRV 110 configured with each of the HVAC units 102 in each room of the building. The ERV or HRV 110 provides pre-conditioned ventilated air to the corresponding HVAC unit 102 to keep the room positively pressurized at a predefined pressure.

In some non-limiting embodiments, the HVAC unit 102 is connected to the HVAC load 118 inside each room to provide conditioned air within the room and extract warm/hot air from the room. Further, the ERV or HRV 110 is connected to an exhaust fan 116 provided in the toilet or bathroom associated with each room. Furthermore, the storage tank of the SHW/DHW unit 104 is connected to showers and faucets to provide hot/warm water in each room of the building.

It would be obvious for a person skilled in the art that while the components of the system 400, 500 shown in FIGS. 4 and 5 have only been illustrated for the Nth floor of the building and are being configured in a single room just for the sake of simplicity and explaining the invention, however, the same components (shown for the Nth floor) of the system 400, 500 may also provide on each floor and each room of the building with either no or minimal changes, and all such embodiments are well within the scope of this invention. Further, while various embodiments of this invention have been elaborated and illustrated for rooms as the AOI in a building, however, this invention can also be implemented at other locations in the building, and all such embodiments are also well within the scope of this invention.

Figure 7A:
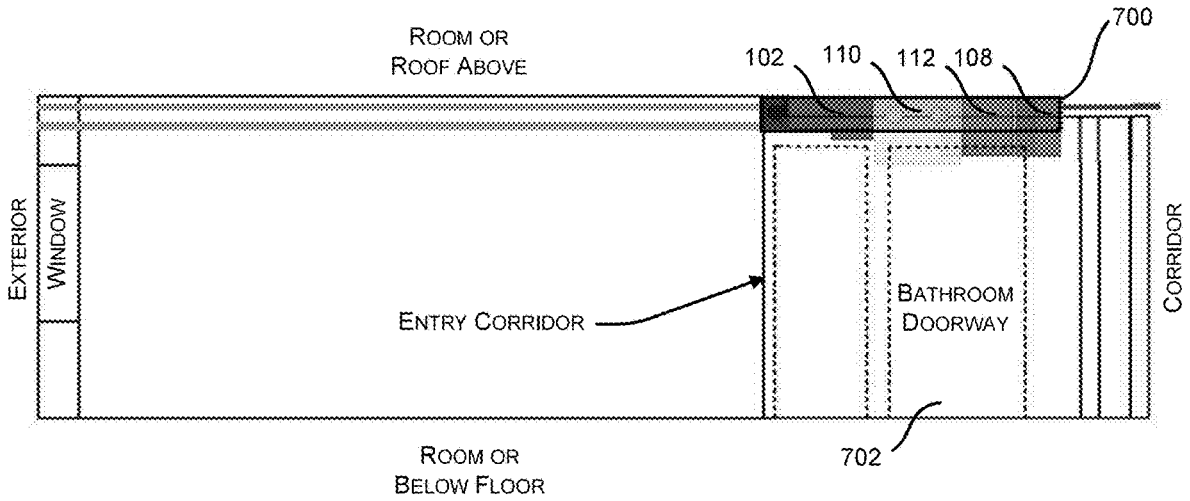
FIG. 7A illustrates exemplary views depicting the packaged system being installed horizontally above a door in entry hall in the AOI/room in accordance with one or more embodiments of the invention.
Figure 7A:
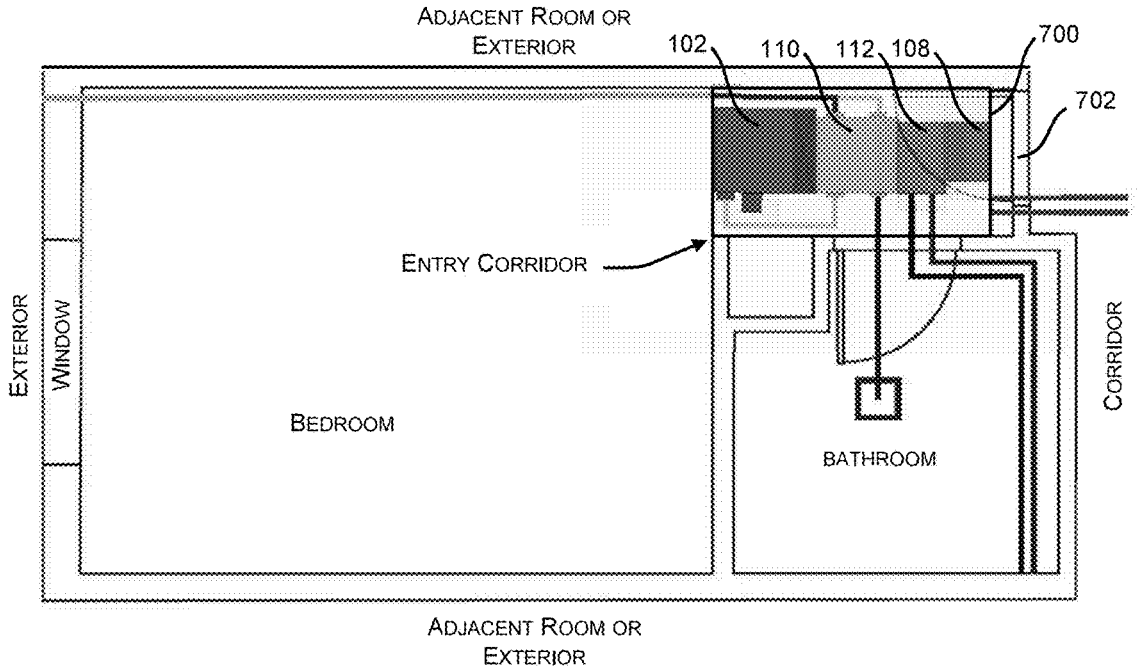
Figure 7B:
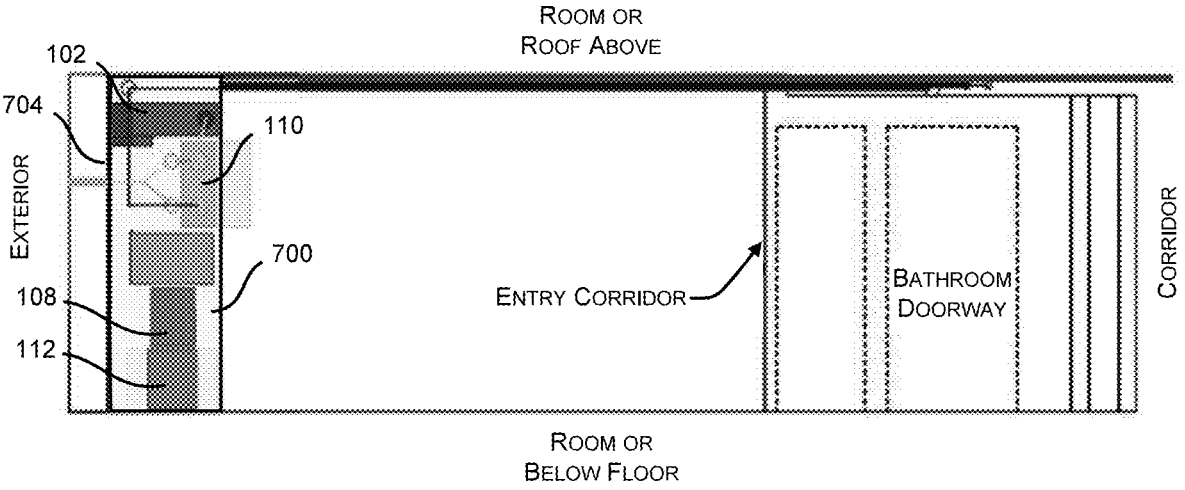
FIG. 7B illustrates exemplary views depicting the packaged system being installed vertically against an exterior wall in the AOI/room in accordance with one or more embodiments of the invention.
Figure 7B:
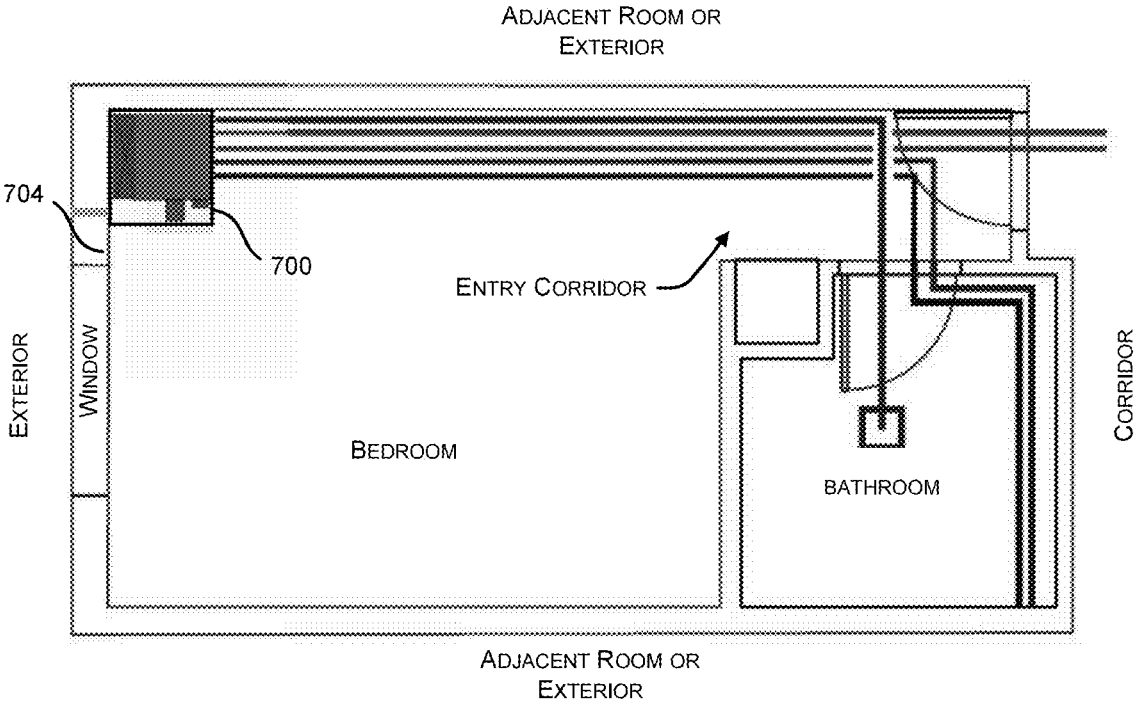

The system of FIG. 1A to 5 are designed in a packaged form factor or modular design, where the components/units (102, 106, 110, 112) of the system are configured within a housing 700 forming a packaged system (also designated as 700, herein) that is compact and easily installable at a desired location in the building or AOI. The locations can be but are not limited to rooms, entry halls, above doors, below a floor, above the floor, ceiling, corridors, staircases, basement, and storage spaces associated with the building. For instance, the packaged system 700 can be installed in a horizontal orientation on each floor above the door 702 in the entry hall in the AOI as shown in FIG. 7A. Further, the packaged system 700 can be installed in a vertical orientation at exterior walls 704 at the AOI as shown in FIG. 7B. In addition, the packaged system 700 can also be designed to be horizontally or vertically fitted in a closet, above doors 702, walls 704, entry hall, ceiling, corridors, staircases, basement, and storage spaces associated with the AOI or building, but not limited to the like.

Figure 6:
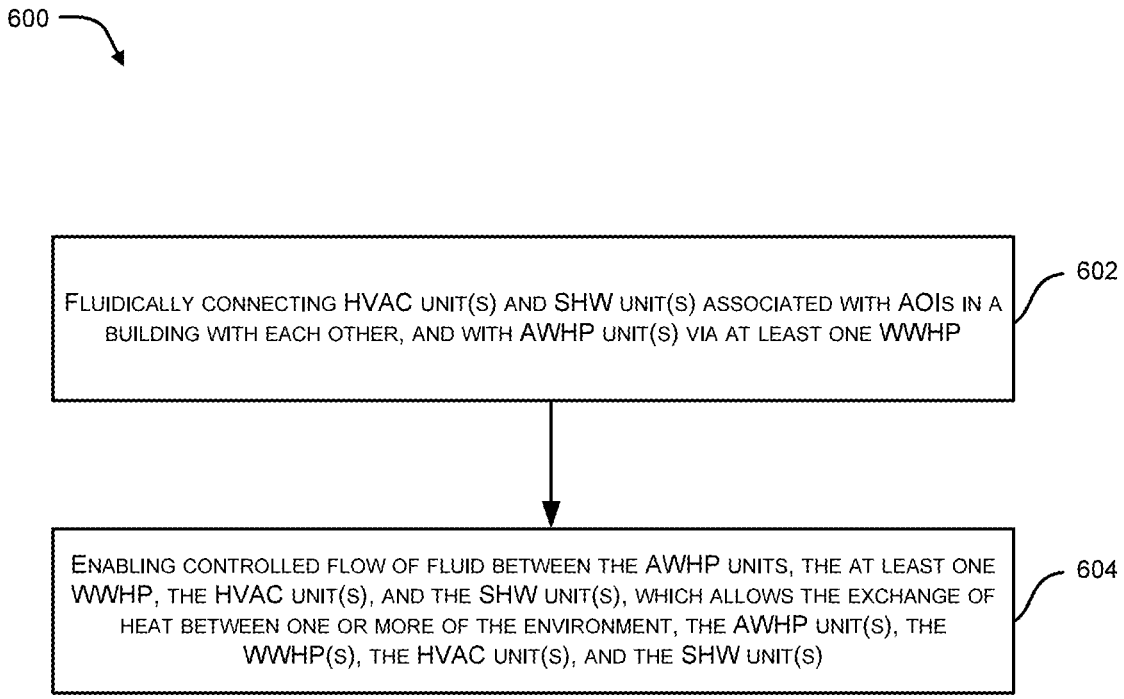
FIG. 6 is a flow diagram illustrating an exemplary embodiment of a method of integrating existing HVAC and SHW/DHW units of a building for enabling the exchange of recovered heat between the HVAC and SHW/DHW units of the building in accordance with one or more embodiments of the invention.

Referring to FIG. 6, method 600 of integrating existing or newly installed HVAC and SHW loads (units) of a building in a modular, efficient, and cost-effective way is illustrated, which provides comfort conditioning, sanitary hot water, and ventilation in the building and enables the exchange of recovered heat between the HVAC and SHW loads configured in rooms (AOI) of the building. Method 600 involves at least one WWHP and one or more AWHP units. Method 600 includes step 602 of fluidically connecting the one or more HVAC units and the one or more SHW units associated with each room of the building with each other, and with the one or more AWHP units via at least one WWHP unit. Method 600 further includes step 604 of enabling a controlled flow of fluid between the AWHP units, the at least one WWHP, the HVAC units, and the SHW units, which allows the exchange of heat between one or more of the environments, the AWHP units, the WWHP, the HVAC units, and the SHW units, thereby facilitating in maintaining predefined temperatures in the rooms/AOI, and of the water supplied by the SHW units in the bathroom associated with the rooms/AOI.

In addition, method 600 includes the steps of storing the heat provided by the WWHP in a thermal storage unit comprising a phase-changing material, and transferring the stored heat to the SHW units and/or to the HVAC units for reheating the HVAC units. Further, method 600 includes the steps of storing cold water or heat generated by the WWHP units in a buffer tank that is used as the thermal storage unit and later transferring the stored cold water or stored heat to the HVAC units based on the heating season or cooling season requirements. Furthermore, method 600 includes the step of supplying pre-conditioned ventilated air, by an ERV or HRV, to the rooms when at least one occupant is present in the corresponding room.

During HVAC cooling operations, the AWHP units reject heat from the common loop into the environmental air, providing a tempered loop for the HVAC WWHPs or common WWHP to provide cooling capacity to the HVAC units and for the SHW/DHW WWHP to provide heating capacity to the SHW unit. Further, the return water from the HVAC WWHP or common WWHP can be diverted away from the common loop return stream into the SHW/DHW WWHP supply stream so that the rejected HVAC heat can be recovered in the system into the SHW unit. Besides, when no SHW load exists, the return water can be piped and directed back to the common loop.

Further, during HVAC heating operations, the AWHP units extract heat into the common loop from the environmental air, providing a tempered loop for the HVAC WWHPs or common WWHP to provide heating capacity to the HVAC unit and for the SHW/DHW WWHP or common WWHP to provide heating to the SHW unit. Further, the HVAC WWHP and the SHW/DHW WWHP can be sequenced to operate non-coincidentally when the AWHP units cannot provide sufficient capacity to serve both loads simultaneously.

The controller 128 prioritizes SHW units, as a decrease in hot water discharge temperature is immediately felt by the occupant or directly connected appliance effectiveness. While HVAC units can be cycled due to comparatively slow temperature drift in rooms. When the discharge temperature of the SHW unit decreases below a set threshold, the system sends capacity only to SHW generation, allowing the room air temperature to drift within limits. However, if the temperature exceeds these limits, the system can then activate the SHW unit's supplemental electrical heat and send capacity back to room conditioning.

The controller 128 used in this invention (system and method) can include one or more processors operatively coupled to a memory storing instructions executable by the processor. Further, the system can also include a set of actuators in communication with the processor of the controller 128. These actuators are operatively connected to the valves 124, HVAC units, SHW units, WWHPs, and AWHP units. The controller 128 is configured to receive the data captured by the flow meters 126, and set of sensors 120 including the temperature sensors, humidity sensors, and occupancy sensors. The controller 128 can accordingly actuate at least one of the valves 124 to control the flow and direction of flow of the fluid between respective components of the system and also control the operation of the AWHP units, the WWHPs, the HVAC units, the SHW units, and the ERVs or HRVs in the system, to enable the exchange of recovered or rejected heat between HVAC units and the SHW units in the building, thereby efficiently utilizing and distributing the recovered or rejected heat in the building to facilitate maintaining predefined temperatures in the room, and of the water supplied by the SHW units. In addition, the controller 128 can operate the ERV or HRV to supply pre-conditioned ventilated air to the HVAC unit.

The AWHP unit used in the invention (system and method) includes an outdoor unit that takes in heat from the ambient air (environment) and transfers it to a coolant (for example water) A compressor then increases the temperature of the coolant that transfers the heat to HVAC units or SHW units via the WWHPs. The hot water is circulated to the WWHPs, and cold water from the WWHPs is transported back to the AWHP unit. The coolant is then transferred back to the outdoor unit. Similarly, by reversing the process above, the coolant in the outdoor unit of the AWHP unit takes the heat from the WWHPs and releases it into the outside environment, and returns cool water to the WWHPs.

The WWHP used in this invention (system and method) is simply a water-to-water heat pump that functions as a heater as well as a cooler. WWHPs can be used for both cooling and heating purposes and can be very economical when used in combination with the HVAC unit and SHW unit. The WWHP work by reversing the flow of a coolant from the compressor through a condenser and evaporation coils. In the heater mode, the indoor coil of the WWHP becomes a condenser while the outdoor coil acts as an evaporator through which the coolant conveys the thermal energy to the indoor coil. The thermal energy is then transferred to the AWHP units or to the HVAC units and SHW units, which are then used for various heating purposes. In the cooling mode, the indoor coil acts as the evaporator while the outdoor coil acts as the condenser making it act as a cooler or air conditioner.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprise" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A modular HVAC-SHW system comprising:

an indoor heating, ventilation and air conditioning (HVAC) unit configured in an area of interest (AOI);

a sanitary or domestic hot water (SHW/DHW) unit configured in the AOI; and an outdoor air-to-water heat pump (AWHP) unit fluidically connected to the HVAC unit and the SHW/DHW unit through a water-to-water heat pump (WWHP), wherein the AWHP unit is configured to enable the exchange of heat between environment and the WWHP, and the WWHP is configured to enable the exchange of heat between any of the AWHP unit, the HVAC unit, and the SHW/DHW unit.

2. The system of claim 1, wherein the system comprises a heat storage unit configured between the WWHP and the SHW unit, wherein the heat storage unit comprises one or more of a phase-changing material, and a water tank that is adapted to store heat provided by the WWHP and transfer the stored heat to the SHW/DHW unit.

3. The system of claim 2, wherein the system comprises:

a set of conduits connected between the AWHP unit and the WWHP, the WWHP and the HVAC unit, the WWHP and the SHW/DHW unit, and an energy recovery ventilator (ERV) or a heat recovery ventilator (HRV) and the HVAC unit, to fluidically and thermally connect the AWHP unit with the WWHP, the WWHP with the HVAC unit, the WWHP with the SHW/DHW unit, and the ERV with the HVAC unit; and a set of valves configured in the set of conduits to control the flow rate and direction of fluid between the AWHP unit and the WWHP, the WWHP and the HVAC unit, the WWHP and the SHW/DHW unit, and the ERV or HRV and the HVAC unit.

4. The system of claim 3, wherein the system comprises:

a set of temperature sensors configured with the AWHP unit, the WWHP, the HVAC unit, the SHW/DHW unit, and the thermal storage unit, to monitor the temperature of the fluid across the system and monitor the temperature of the AOI; and a set of flow meters to monitor the flow rate and the direction of the fluid through the set of conduits.

5. The system of claim 4, wherein the system comprises a controller in communication with the set of temperature sensors and a set of relative humidity sensors, wherein the controller is configured to actuate at least one of the valves to enable the exchange of heat between one or more of the environments, the HVAC unit, and the SHW/DHW unit, to facilitate maintaining predefined temperatures in the room, and of the water supplied by the SHW/DHW unit.

6. The system of claim 5, wherein the system comprises an energy recovery ventilator (ERV) or a heat recovery ventilator (HRV) configured with the HVAC unit, the ERV or the HRV is operable to provide pre-conditioned ventilated air to the HVAC unit to keep the AOI pressurized at a predefined pressure.

7. The system of claim 6, wherein the system comprises an occupancy sensor positioned in the AOI and configured to detect the presence of occupants in the AOI, wherein the ERV or HRV is operatively coupled to the occupancy sensor and the controller, wherein upon detection of the presence of occupants in the AOI, the controller operates the ERV or HRV to supply pre-conditioned ventilated air to the HVAC unit.

8. The system of claim 1, wherein the heat rejected by the HVAC unit into the WWHP unit is supplied to the SHW/DHW unit or is supplied to the HVAC unit to provide reheat for the HVAC unit.

9. The system of claim 1, wherein the system comprises a heat storage unit adapted to store heat or cold water provided by the WWHP unit and transfer the stored heat or cold water back to the HVAC unit based on cooling and heating requirement of the HVAC unit.

10. The system of claim 1, wherein the system comprises a three-way control valve configured between the WWHP unit, an ambient loop (AL) return line, and AL supply line, wherein the AL supply line and the AL return line are fluidically connected between the AWHP unit and an ambient water flow of the AOI, wherein, the three-way control valve is actuated to select source water from the AL supply line or the AL return line based on temperatures to produce optimum operational efficiency.

11. A modular HVAC-SHW/DHW system comprising:

one or more heating, ventilation, and air conditioning (HVAC) units configured in one or more areas of interest (AOI);

a first set of water-to-water heat pumps (WWHP) fluidically connected to each of the HVAC units, such that there being at least one of the first WWHP fluidically connected to one of the HVAC units;

one or more sanitary or domestic hot water (SHW/DHW) units configured in the one or more AOI;

a second set of WWHPs fluidically connected to each of the SHW/DHW units, such that there being at least one of the second WWHP fluidically connected to one of the SHW/DHW units.

12. The system of claim 11, wherein the system comprises an energy recovery ventilator (ERV) or a heat recovery ventilator (HRV) configured with each of the HVAC units, the ERV or the HRV is operable to provide pre-conditioned ventilated air to each of the HVAC units to keep the one or more AOI pressurized at a predefined pressure.

13. The system of claim 11, wherein the heat rejected by the HVAC units into the corresponding first WWHP units is supplied to the one or more SHW/DHW units or to the one or more HVAC units to provide reheat for the corresponding HVAC units.

14. The system of claim 11, wherein each of the second WWHPs is further fluidically connected to each of the first WWHPs, which allows the exchange of heat between the first set of WWHPs and the second set of WWHPs.

15. The system of claim 14, further comprising one or more air-to-water heat (AWHP) units, each fluidically connected to the first set of WWHPs and the second set of WWHPs.

16. The system of claim 15, wherein the AWHP units are configured to enable the exchange of heat between environment and one or more of the first set of WWHPs and the second set of WWHPs, which correspondingly enables the exchange of heat between one or more of the environments, the one or more HVAC units, and the one or more SHW/DHW units.

17. A method for efficient heat exchange between an indoor HVAC unit and SHW/DHW unit associated with one or more AOI of a building and an outdoor environment, the method comprising the steps of:

fluidically connecting one or more indoor HVAC units and one or more SHW units or one or more DHW units associated with one or more AOI in a building with each other, and with one or more AWHP units via at least one WWHP unit, wherein the AWHP units are configured to thermally connect the at least one WWHP to the outdoor environment; and enabling controlled flow of fluid between the AWHP units, the at least one WWHP, the one or more indoor HVAC units, and the SHW/DHW units, which allows the exchange of heat between the outdoor environments, the AWHP units, the WWHP, the one or more indoor HVAC units, and the SHW/DHW units, thereby facilitating in maintaining predefined temperatures in the one or more AOI, and of the water supplied by the SHW/DHW units in the one or more AOI.

18. The method of claim 17, wherein the method comprises the steps of:

storing the heat provided by the at least one WWHP in a heat storage unit comprising a phase-changing material; and transferring the stored heat to the SHW/DHW units and/or to the one or more indoor HVAC units for reheating the one or more indoor HVAC units.

19. The method of claim 17, wherein the method comprises the steps of:

storing cold water or heat generated by the WWHP units in a buffer tank; and transferring the stored cool water or stored heat to the one or more indoor HVAC units based on the cooling and heating requirement of the one or more indoor HVAC units.

20. The method of claim 17, wherein the method comprises the steps of supplying pre-conditioned ventilated air, by an ERV or HRV, to the one or more AOI when at least one occupant is present in the corresponding AOI.

* * * * *